US008814348B2

(12) United States Patent
Enomoto

(10) Patent No.: US 8,814,348 B2
(45) Date of Patent: Aug. 26, 2014

(54) CONVEYANCE APPARATUS AND IMAGE FORMING APPARATUS

(75) Inventor: Hisashi Enomoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 12/406,471

(22) Filed: Mar. 18, 2009

(65) Prior Publication Data

US 2009/0237440 A1 Sep. 24, 2009

(30) Foreign Application Priority Data

Mar. 24, 2008 (JP) ..... 2008-076407
Mar. 3, 2009 (JP) ..... 2009-049717

(51) Int. Cl.
*B41J 2/01* (2006.01)

(52) U.S. Cl.
USPC ..... 347/104; 347/16; 347/9

(58) Field of Classification Search
CPC ..... B41J 11/006
USPC ..... 347/5, 9, 14, 16, 19, 104; 399/124; 271/296
See application file for complete search history.

(56) References Cited

U.S. PATENT DOCUMENTS

| | | | | |
|---|---|---|---|---|
| 5,806,850 | A * | 9/1998 | Yoneoka et al. | 271/296 |
| 7,263,312 | B2 * | 8/2007 | Park | 399/124 |
| 2002/0130941 | A1 * | 9/2002 | Tanaami | 347/104 |
| 2004/0046851 | A1 * | 3/2004 | Yang et al. | 347/104 |
| 2004/0263553 | A1 * | 12/2004 | Mizuno | 347/16 |
| 2007/0030299 | A1 * | 2/2007 | Izuchi | 347/16 |
| 2008/0106565 | A1 * | 5/2008 | Miyazawa | 347/16 |

FOREIGN PATENT DOCUMENTS

| | | |
|---|---|---|
| JP | 8-245062 | 9/1996 |
| JP | 11-246078 | 9/1999 |
| JP | 2005-221522 | 8/2005 |

* cited by examiner

*Primary Examiner* — Lam S Nguyen
(74) *Attorney, Agent, or Firm* — Fitzpatrick, Cella, Harper & Scinto

(57) ABSTRACT

A conveyance apparatus has a first conveyance path along which a printing medium is conveyed, a first discharge port, and a second conveyance path which causes reversal of the conveyance direction of the printing medium partially exposed from the discharge port and feeds the printing medium to the first conveyance path again. The apparatus further includes an estimation unit which estimates an amount of exposure of the printing medium at the discharge port, a decision unit which, when jamming of the printing medium occurs, determines a printing-medium removal method in accordance with the amount of exposure estimated, and an output unit which outputs the determined removal method.

33 Claims, 6 Drawing Sheets

CONVEYANCE APPARATUS AND IMAGE FORMING APPARATUS

BACKGROUND OF THE INVENTION

1. Field of the Invention

The present invention relates to a conveyance apparatus for conveying a printing medium and, more particularly, to processing of a printing medium that remains retained within a conveyance apparatus in the process of being conveyed through the apparatus.

2. Description of the Related Art

In a conveyance apparatus for conveying paper, paper jam, which is a phenomenon in which the paper is not conveyed properly and remains retained in the conveyance path, often occurs. If conveyance is allowed to continue with the paper left jammed inside the apparatus, the next sheet of paper also will experience jamming. The jammed sheet of paper, therefore, must be removed. In addition, it is necessary that the occurrence of a paper jam be sensed accurately.

The specification of Japanese Patent Laid-Open No. 8-245062 proposes a method of sensing the position of jammed paper by placing in the conveying path a number of sensing units to sense whether or not paper is present. The specification of Japanese Patent Laid-Open No. 2005-221522 proposes a method whereby paper situated in a double-sided conveyance unit is discharged to the exterior of the apparatus in a direction opposite the normal conveyance direction and at a speed higher than the normal conveyance speed.

However, in a conveyance apparatus in which the paper is partially exposed to the exterior of the apparatus and the direction of paper conveyance is reversed, a state in which the paper cannot be sensed by any sensing unit arises. In this case, it may not be possible to specify where the paper is situated even if jamming of the paper in the paper conveyance apparatus has been sensed, and therefore it may not be possible to indicate the proper paper removal method to the user.

As a consequence, there are occasions where the user opens and closes a door that is unrelated to paper jam. Generally, when a door of an image forming apparatus is opened, power to a fixing device and other devices turns off and the fixing device cools. Since it takes time for the temperature of the fixing device to recover, downtime during which printing cannot be executed results. Further, if jammed paper is not removed properly, jamming is worsened by succeeding sheets of paper and the apparatus may malfunction.

SUMMARY OF THE INVENTION

Accordingly, the present invention seeks to solve at least one problem among these and other problems. For example, even in the case of a conveyance apparatus in which paper is partially exposed to the exterior of the apparatus and the direction of paper conveyance is reversed, the present invention makes it possible to suppress trouble along the conveyance path while jamming can be dealt with in a manner convenient for the operator. Other features will be understood from a reading of the entire specification.

The present invention is applicable to a conveyance apparatus for conveying a printing medium, and to an image forming apparatus, by way of example. The conveyance apparatus comprises: a first conveyance path along which the printing medium is conveyed; a discharge port which exposes a part of the printing medium to the exterior of the conveyance apparatus when conveyance direction of the printing medium is reversed; a second conveyance path which causes reversal of the conveyance direction of the printing medium partially exposed from the discharge port and conveys the printing medium into the conveyance apparatus; a decision unit which, if a state in which the printing medium remains retained in the apparatus occurs, decides a printing-medium removal method in accordance with amount of discharge of the printing medium at the discharge port; and an output unit which outputs information indicating the removal method decided.

In another respect, there is a conveyance apparatus which comprises: a conveyance path along which the printing medium is conveyed; a discharge port which discharges the conveyed printing medium to the exterior of the conveyance apparatus; a decision unit which decides a printing-medium removal method in accordance with amount of discharge of the printing medium at the discharge port; and an output unit which outputs information indicating the removal method decided.

In still another aspect, there is an image forming apparatus which comprises: an image forming unit which forms an image on a printing medium; a conveyance path which conveys the printing medium in order to form the image on the printing medium; a discharge port which discharges the printing medium, on which the image has been formed by the image forming unit, to the exterior of the image forming apparatus; a decision unit which, if a state in which the printing medium remains retained in the apparatus during the discharge thereof from the discharge port occurs, decides a printing-medium removal method in accordance with amount of discharge of the printing medium at the discharge port; and an output unit which outputs information indicating the removal method decided.

In still yet another aspect, there is an image forming apparatus which comprises: an image forming unit which forms an image on a printing medium; a conveyance path which conveys the printing medium in order to form the image on the printing medium; a discharge port which exposes a part of the printing medium to the exterior of the conveyance apparatus when conveyance direction of the printing medium is reversed in order to form images on both sides of the printing medium; a decision unit which, if a state in which the printing medium remains retained in the apparatus occurs, decides a printing-medium removal method in accordance with amount of discharge of the printing medium at the discharge port; and an output unit which outputs information indicating the removal method decided.

Further features of the present invention will become apparent from the following description of exemplary embodiments with reference to the attached drawings.

DESCRIPTION OF THE EMBODIMENTS

Embodiments of the present invention will be illustrated below. The individual embodiments described below will be useful in order to understand various concepts of the present invention, such as broader, intermediate and narrower concepts thereof. Further, the technical scope of the present invention is determined by the scope of the claims and is not limited by the individual embodiments set forth below.

Figure 1:
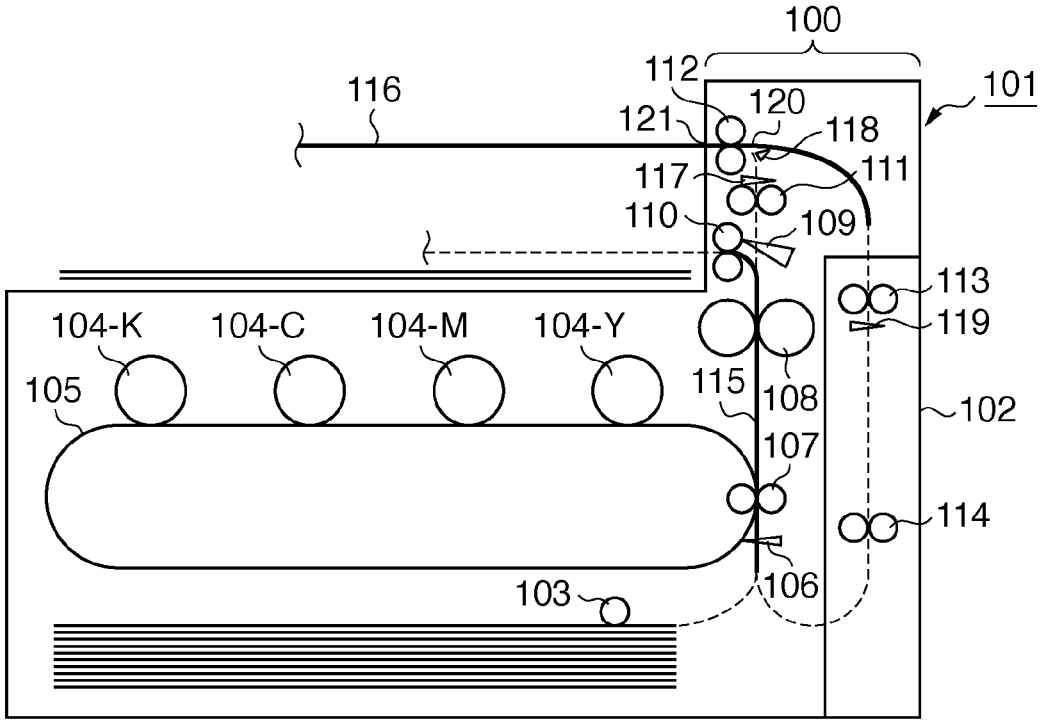
FIG. 1 is a schematic structural view of a multicolor image forming apparatus that employs a paper conveyance apparatus according to an embodiment of the present invention.

FIG. 1 is a schematic structural view of a multicolor image forming apparatus 101 that employs a paper conveyance apparatus 100 according to an embodiment of the present invention. The image forming apparatus 101 is an electrophotographic printer. It should be noted that so long as the apparatus is one that employs a conveyance apparatus that partially exposes paper to the exterior and reverses the direction of paper conveyance, the present invention is applicable. The present invention may therefore be applied to equipment other than an image forming apparatus. Further, the image forming apparatus 101 may be a printing apparatus, copier, multifunction peripheral or facsimile machine. Furthermore, the image forming method may be, e.g., an electrostatic printing method, magnetic printing method, ink-jet printing method, sublimation printing method or offset printing method. It should be noted that there are occasions where "paper" is also referred to as a "printing material", "printing medium", "sheet", "transfer material" and "transfer paper".

The image forming apparatus 101 has one or more doors. A door 102, which is one of these doors, is required to be opened if jammed paper remaining retained within the image forming apparatus is to be removed. Depending upon the position of the jammed paper, however, opening and closing the door 102 may be unnecessary. In the present invention, therefore, when jamming that does not require the opening and closing of door 102 has occurred, either a message for the purpose of suppressing opening and closing of door 102 is output or no message relating to opening and closing of door 102 is output. This enables a reduction in work on the part of the operator, namely the opening and closing of the door at the occurrence of a paper jam. It also enables a reduction in downtime, required heretofore, that was necessary to re-heat a fixing device 108 that cooled owing to opening of the door.

A paper feeding device 103 separates and feeds paper sheets, which are contained in a tray, to a first conveyance path one sheet at a time. Toner-image forming units 104-Y, 104-M, 104-C and 104-K form toner images on or transfer them to a belt-shaped intermediate transfer member 105.

A first paper-presence sensing member 106 indicates that a paper sheet 115 or 116 has arrived in the vicinity of a secondary transfer unit 107. The first paper-presence sensing member 106 indicates "paper present" mechanically or electrically for a period of time from arrival of the leading edge of a paper sheet to departure of the trailing edge. When the trailing edge of the paper departs, the first paper-presence sensing member 106 indicates "paper absent". It should be noted that if the first paper-presence sensing member 106 measures the amount of paper feed (amount of conveyance) from indication of "paper present" to indication of "paper absent", then it can be implemented by a measuring device for measuring length of the paper sheet along the conveyance direction. For example, if the paper conveyance speed is fixed and the unit of amount of feed is time, then the length of the paper sheet along the conveyance direction can be calculated by multiplying the conveyance speed by time.

The fixing device 108 is equipped with a fixing roller for fixing the toner image to the paper. A reversing flapper 109 is a unit for switching between whether a paper sheet that has undergone fixing is directed toward a first discharge port 110 or toward a paper reverse-feed unit in order that double-sided printing may be performed.

The paper reverse-feed unit has the following structure: A pull-in roller 111 is a roller for pulling a sheet of paper, which has been introduced to the paper reverse-feed unit, into a reversing branch point 118. A second paper-presence sensing member 117, which is provided between the pull-in roller 111 and reversing branch point 118, senses whether paper is present or not. Reversing rollers 112 halt conveyance of the paper at a point where a portion of the paper is exposed a stipulated amount from a second discharge port 121 provided at the terminus of the first conveyance path, and then reverse rotation to reverse-feed the paper to the second conveyance path from this point. As a result, the conveyance direction of the paper partially exposed from the second discharge port 121 can be reversed and fed again to the first conveyance path. Thus, the second discharge port 121 functions as a discharge port for exposing a part of the printing medium to the exterior of the conveyance apparatus when the conveyance direction of the printing medium is reversed.

A paper trailing-edge stopping position 120 is the position of the trailing edge of the paper at such time that the paper is stopped temporarily when the conveyance direction of the paper is reversed. In order to always stop the trailing edge of the paper at the paper trailing-edge stopping position 120, it will suffice to exercise control so as to render constant the amount of paper feed from the timing at which there is a transition from presence of paper to absence of paper as sensed by the second paper-presence sensing member 117.

A first conveyance roller 113 provided in the second conveyance path conveys the paper after the reversal thereof. A third paper-presence sensing member 119 senses that the paper has arrived at the first conveyance roller 113. The third paper-presence sensing member 119 is one example of one or more printing-medium detection units provided in the second conveyance path. The printing-medium detection unit detects absence or presence of the printing medium conveyed on the second conveyance path. A second conveyance roller 114 conveys the paper to the first conveyance path again. The first conveyance path is the conveyance path from the paper feeding device 103 to the second discharge port 121. The second conveyance path is a conveyance path from the reversing branch point 118 to the point of convergence with the first conveyance path. The second conveyance path is a conveyance path on which the conveyance direction of the printing medium partially exposed from the discharge port is reversed and transported into the interior of the conveyance apparatus.

The image forming apparatus 101 determines that jamming has occurred in a case where, after the paper conveyance direction has been reversed, the third paper-presence sensing member 119 does not indicate "paper present" even if the paper is conveyed more than the predetermined stipulated amount (i.e., for a time longer than the stipulated time).

Figure 2:
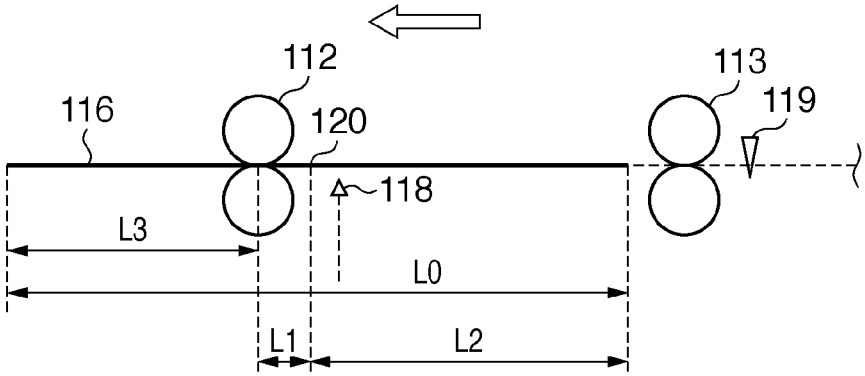
FIG. 2 is a schematic view illustrating a unit for reversing paper conveyance direction in the embodiment.

FIG. 2 is a schematic view illustrating a unit for reversing paper conveyance direction in the embodiment. In order to describe various distances relating to paper, the conveyance path of the paper reverse-feed unit is illustrated as being linear in FIG. 2 and the direction of the large arrow is the direction in which the paper is conveyed.

In FIG. 2, L0 represents the length of a sheet of paper in the conveyance direction, and L1 is the distance from a nip position of the reversing rollers 112 to the paper trailing-edge stopping position 120 and is a fixed value. It should be noted that the edge of the paper sheet in the traveling direction is referred to as the leading edge. If the paper conveyance direction is reversed, the paper is conveyed with the edge referred to thus far as the trailing edge becoming the leading edge. In accordance with this approach, the paper trailing-edge stopping position 120 becomes a paper leading-edge stopping position.

Further, L2 indicates the amount of paper conveyance after reversal and L3 represents the length of the paper sheet upstream from the nip position of the reversing rollers 112 in the conveyance direction. The conveyance amount L2 and length L3 vary while the paper is being transported. Further, it will be understood from the drawing that the following equation holds:

$$L0=L1+L2+L3$$

In the image forming apparatus 101, the paper conveyance direction reverses in a state in which the paper is exposed to the exterior of the second discharge port 121 by an exposure amount conforming to length L3. It should be noted that the precise exposure amount is the distance obtained by subtracting the distance from the nip position to the second discharge port 121 from L3.

Figure 3:
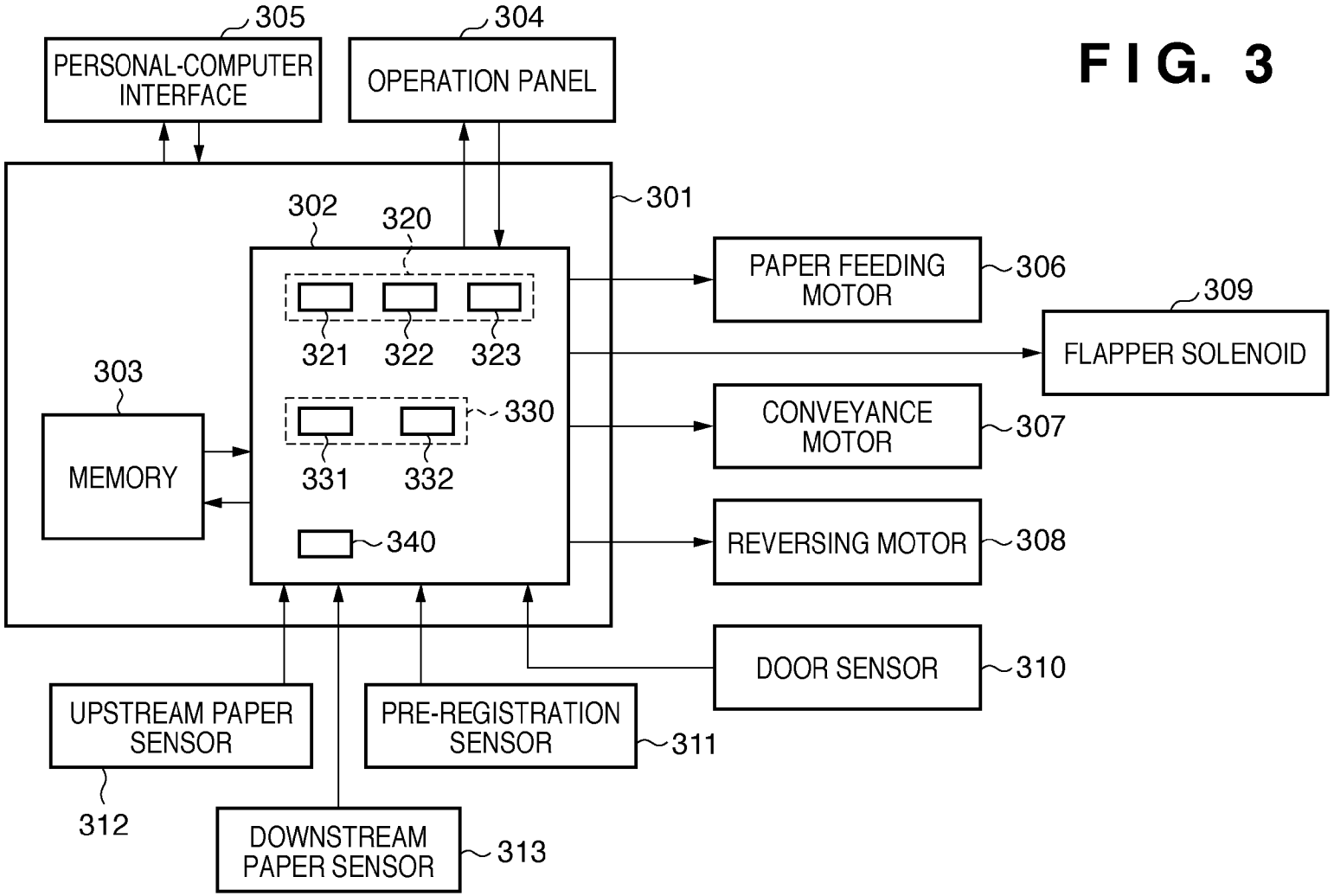
FIG. 3 is a diagram illustrating an example of a controller according to the embodiment.

FIG. 3 is a diagram illustrating an example of a controller according to the embodiment. A controller 301 of the image forming apparatus 101 is a unit for controlling the overall image forming apparatus 101 and has a jammed-paper controller 302. A memory 303 is a storage device used by the jammed-paper controller 302 and stores a counted value or result of calculation relating to the amount of paper conveyance.

An operation panel 304 has a display unit for displaying to the operator a removal method for removing a sheet of paper retained within the apparatus, and a button, etc., for notifying the controller 301 of the image forming apparatus of the fact that the operator has removed the paper. A personal-computer interface 305 connects the image forming apparatus 101 to a personal computer or LAN in order that data may be sent and received.

A paper feeding motor 306 is for driving a paper feeding roller possessed by the paper feeding device 103. A conveyance motor 307 drives a secondary transfer roller possessed by the secondary transfer unit 107 and a fixing roller possessed by the fixing device 108. A reversing motor 308 is for reversing and conveying the paper in the paper reverse-feed unit and drives the reversing rollers 112, first conveyance roller 113 and second conveyance roller 114.

A flapper solenoid 309 controls the direction of the reversing flapper 109 for selecting the discharge port of the paper after the paper has undergone fixing. By switching the flapper solenoid 309 on and off, the controller 301 of the image forming apparatus is capable of selecting whether to guide the paper, on which the image has been fixed, to the first discharge port 110 or to the second conveyance path.

A door sensor 310 senses opening and closing of the door 102. A pre-registration sensor 311 is connected to the first paper-presence sensing member 106 and senses whether the first paper-presence sensing member 106 is indicating presence or absence of paper. An upstream paper sensor 312 is connected to the second paper-presence sensing member 117 and senses whether the second paper-presence sensing member 117 is indicating presence or absence of paper. A downstream paper sensor 313 is connected to the third paper-presence sensing member 119 and senses whether downstream paper sensor 313 is indicating presence or absence of paper.

The image forming operation in the image forming apparatus 101 is executed as follows, by way of example: First, toner images are formed on the toner-image forming units 104-Y, 104-M, 104-C and 104-K. The toner images that have been formed on the toner-image forming units 104-Y, 104-M, 104-C and 104-K are transferred to the intermediate transfer member 105 by primary transfer, whereby a color toner image is formed.

By rotating the paper feeding motor 306, paper sheets 115 and 116 fed to the first conveyance path by the paper feeding device 103. The toner image is transferred from the intermediate transfer member 105 to the paper by secondary transfer in the secondary transfer unit 107. The as-yet unfixed toner image is fixed to the paper by the fixing device 108. The secondary transfer roller and fixing roller are rotatively driven as a result of the controller 301 of the image forming apparatus starting up the conveyance motor 307.

It should be noted that the controller 301 of the image forming apparatus measures the amount of paper feed of conveyance motor 307 and stores it in the memory 303 in the period over which the first paper-presence sensing member 106 indicates presence of paper owing to the paper 115, 116, i.e., the period over which the pre-registration sensor 311 senses the presence of paper. The maximum value of amount of paper feed corresponds to the paper length L0 of paper 115, 116.

The controller 301 of the image forming apparatus controls the flapper solenoid 309, whereby the paper is guided to the first discharge port 110 or pull-in roller 111 in accordance with the reversing flapper 109.

When the trailing edge of the paper arrives at the paper trailing-edge stopping position 120, the controller 301 of the image forming apparatus halts the reversing motor 308. Halt timing is when a prescribed length of time has elapsed from a timing at which the upstream paper sensor 312 senses a change for presence of paper to absence of paper as sensed by the second paper-presence sensing member 117. The prescribed length of time is obtained by dividing the distance from the pull-in roller 111 to the reversing rollers 112 by the paper conveyance speed. As a result, the paper is halted in a state in which it is clamped between the reversing rollers 112.

It should be noted that the jammed-paper controller 302 has an estimating unit 320 for estimating the amount of exposure of paper at the second discharge port, and a decision unit 330 for deciding on the paper removal method in accordance with the estimated value of amount of exposure. The estimating unit 320 includes a measurement unit 321 for measuring the length L0 of the paper in the conveyance direction; a measuring unit 322 for measuring feed amount L2; and a calculation unit 323 for calculating the exposure amount L3 from the length L0 and pulled-in amount L2. Here L2 is the amount by which the paper, which has been halted temporarily in order for the conveyance direction thereof to be reversed, has been pulled into the second conveyance path. That is, it is the amount of feed to the second conveyance path. The estimating unit 320 functions as a unit for estimating amount of exposure of the printing medium at the discharge port.

When a state in which the printing medium remains retained within the apparatus occurs, the decision unit 330 functions as a unit for deciding the removal method of the printing medium in accordance with the amount of exposure (amount of discharge) of the printing medium at the discharge port. The decision unit 330 includes a comparator 331 and a selector 332. The comparator 331 compares the estimated amount of exposure and a prescribed threshold value when paper jam (the state in which the printing medium remains retained within the apparatus) occurs. When the amount of exposure is equal to or greater than the threshold value, the selector 332 selects, as information indicating the removal method, a first message that prompts the operator to pull the paper out of the second discharge port manually.

The jammed-paper controller 302 further includes an automatic paper-discharge unit 340 which, when a paper jam has occurred, tries to discharge the paper automatically if any of the one or more paper-presence sensing members provided in the second conveyance path has sensed the presence of paper.

Figure 4:
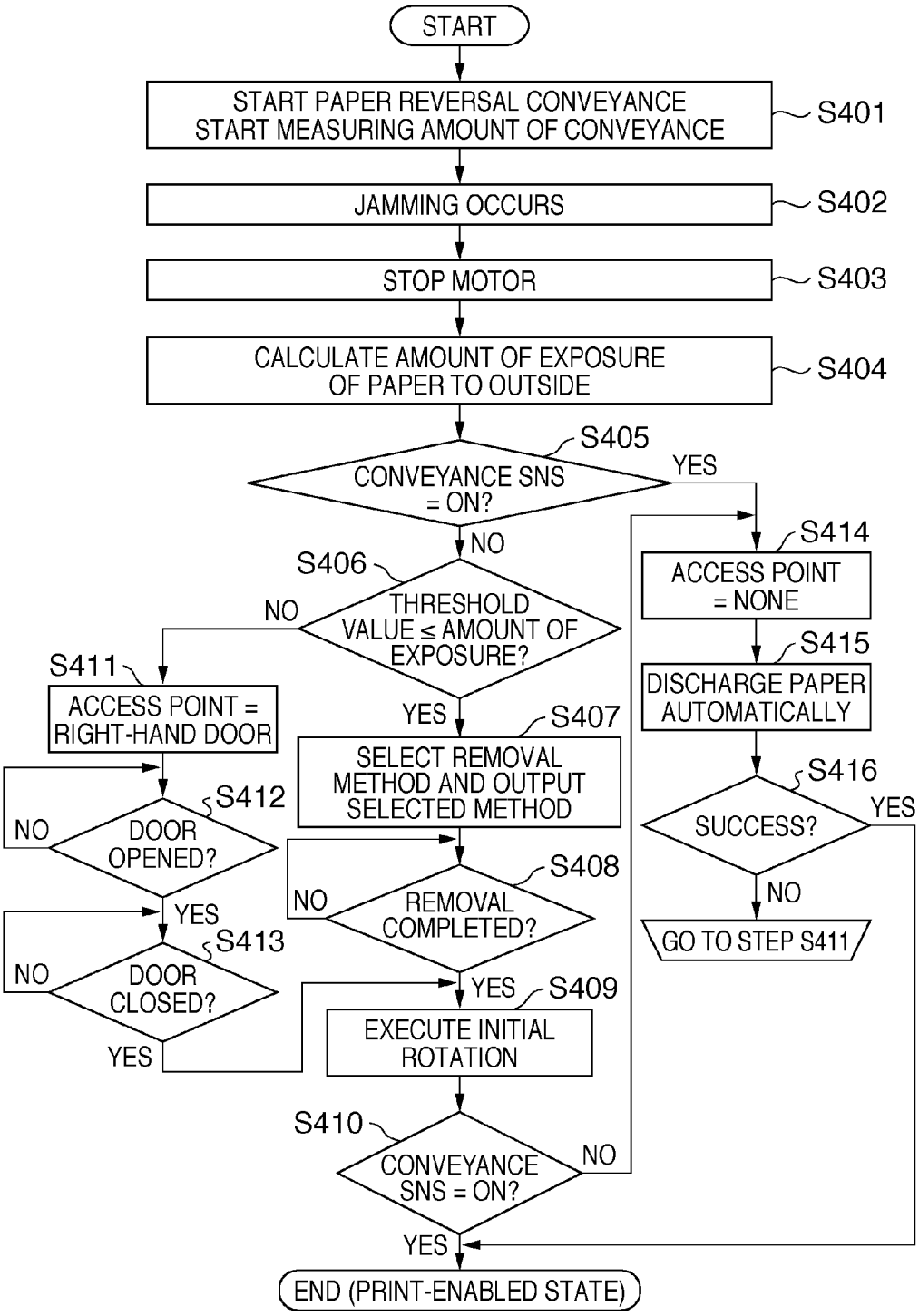
FIG. 4 is a flowchart illustrating an example of jam processing according to the embodiment.

FIG. 4 is a flowchart illustrating an example of jam processing according to the embodiment. Here processing after paper reversal conveyance has started will be described in detail. It will be assumed that the length L0 of paper in the conveyance direction has been measured beforehand by the measurement unit 321.

At step S401, the controller 301 of the image forming apparatus starts paper reversal conveyance and starts measurement of the amount of conveyance (amount of feed). For example, the controller 301 of the image forming apparatus reverses the direction of rotation of reversing motor 308, thereby also reversing the rotating direction of the reversing rollers 112. As a result, the paper is guided to the first conveyance roller 113. The measurement unit 322 starts measuring the feed amount L2 of paper by the reversing rollers 112. If the reversing motor 308 is a stepping motor, then L2 is a value proportional to the number of feed steps.

At step S402, the jammed-paper controller 302 discriminates whether jamming has occurred. For example, in a case where the downstream paper sensor 313 cannot sense presence of paper even though L2 has exceeded the stipulated value, the jammed-paper controller 302 recognizes that jamming has occurred. Control proceeds to step S403 when jamming occurs.

At step S403, the jammed-paper controller 302 halts the reversing motor 308 in order that conveyance of the paper 116 will be halted. As a result, rotation of the reversing rollers 112, first conveyance roller 113 and second conveyance roller 114 is halted. At this time the measurement unit 322 stops measuring L2.

It should be noted that the jammed-paper controller 302 rotates the conveyance motor 307 for a length of time necessary to discharge the leading sheet of paper 115 to the exterior of the apparatus. As a result, since the secondary transfer roller, fixing roller and paper discharge roller continue rotating, the paper 115 is discharged to the exterior from the first discharge port 110. When the necessary period of time elapses, the jammed-paper controller 302 halts the conveyance motor 307. The image forming apparatus 101 thenceforth shifts to a jam state, namely a state in which continuation of printing is not possible.

At step S404, the calculation unit 323 calculates the exposure amount L3 of paper 116 in accordance with the following equation and stores L3 in memory 303:

$$L3=L0-(L1+L2)$$

As mentioned above, L0 is the length of paper 116 in the conveyance direction as measured by the measurement unit 321; L2 is the amount of feed of paper as measured by the measurement unit 322; and L1 is the distance, which is a fixed value, from the nip position to the paper trailing-edge stopping position. Thus, the estimating unit 320 is capable of calculating and estimating the amount of exposure of the paper.

Since jamming has occurred with the paper 116 remaining retained in a section of the apparatus in which none of the paper-presence sensing members has been deployed, the precise position of the paper 116 is unknown. However, the paper 116 is not conveyed up to a position where the amount of feed by the reversing rollers 112 will be exceeded. That is, the maximum value of distance for arrival of the edge of the paper 116 is the feed amount L2 at most. Accordingly, the minimum value of exposure amount L3 can be decided from the equation shown above.

At step S405, the jammed-paper controller 302 determines whether any paper sensor provided on the second conveyance path is sensing the presence of paper. In accordance with FIG. 1, the second conveyance path is provided only with the downstream paper sensor 313 (the third paper-presence sensing member 119), although it may be provided with a plurality of paper sensors. If the downstream paper sensor 313 is not sensing the presence of paper, then control proceeds to step S406.

At step S406, the comparator 331 compares the exposure amount L3 and the prescribed threshold value. That is, the comparator 331 determines whether the exposure amount L3 is equal to or greater than the prescribed threshold value. It is preferred that the threshold value be made the smallest amount of exposure of the paper that will allow the operator to positively remove the paper exposed to the exterior of the apparatus. The threshold value has been stored in the memory 303 as a previously set value. Furthermore, the threshold value can be set appropriately in accordance with the arrangement of the conveyance path and configuration of the discharge port of the apparatus. The reason is that if the amount of exposure of the paper is inadequate, the operator will not be able to grasp the edge of the paper and extraction of the paper from the apparatus will be difficult. If the exposure amount L3 is equal to or greater than the threshold value, control proceeds to step S407.

At step S407, the selector 332 selects the first message that prompts the operator to pull the paper out of the second discharge port (TOP BIN) and outputs the message to the operation panel 304. The selector 332 thus selects the message that conforms to the amount of exposure. It is preferred that the first message include a message for suppressing the opening and closing of the door 102 with which the paper conveyance apparatus is provided. The reason for this is that if a sheet of paper is currently exposed from the second discharge port 121, it is unnecessary to open and close the door 102 and, hence, the fixing device 108 does not cool unnecessarily. The first message may further include a message requesting the pressing of a confirmation button provided on the user interface. It should be noted that the user interface may be implemented by the operation panel 304 or realized as the GUI of a personal computer via the personal-computer interface 305 and printer driver on the side of the personal computer.

At step S408, the jammed-paper controller 302 determines whether removal of the paper has been completed. For example, the jammed-paper controller 302 determines whether the operator has pressed a confirmation button on the operation panel 304 that is to be pressed after removal of paper. Control proceeds to step S409 if removal has been completed.

At step S409, the jammed-paper controller 302 rotates the conveyance motor 307 and reversing motor 308 initially.

At step S410, the jammed-paper controller 302 determines whether any paper-presence sensing member is sensing presence of paper. If the presence of paper is not being sensed, the jammed-paper controller 302 restores the apparatus to the print-enabled state. If the presence of paper is sensed, however, then control proceeds to step S414. It should be noted that steps from step S414 onward correspond to processing for discharging paper automatically.

If the third paper-presence sensing member 119 indicates absence of paper ("NO" at step S405) and, the exposure amount L3 is less than the threshold value ("NO" at step S406), the farthest downstream position at which the leading edge of the paper could possibly have reached can be ascertained.

Figure 5A:
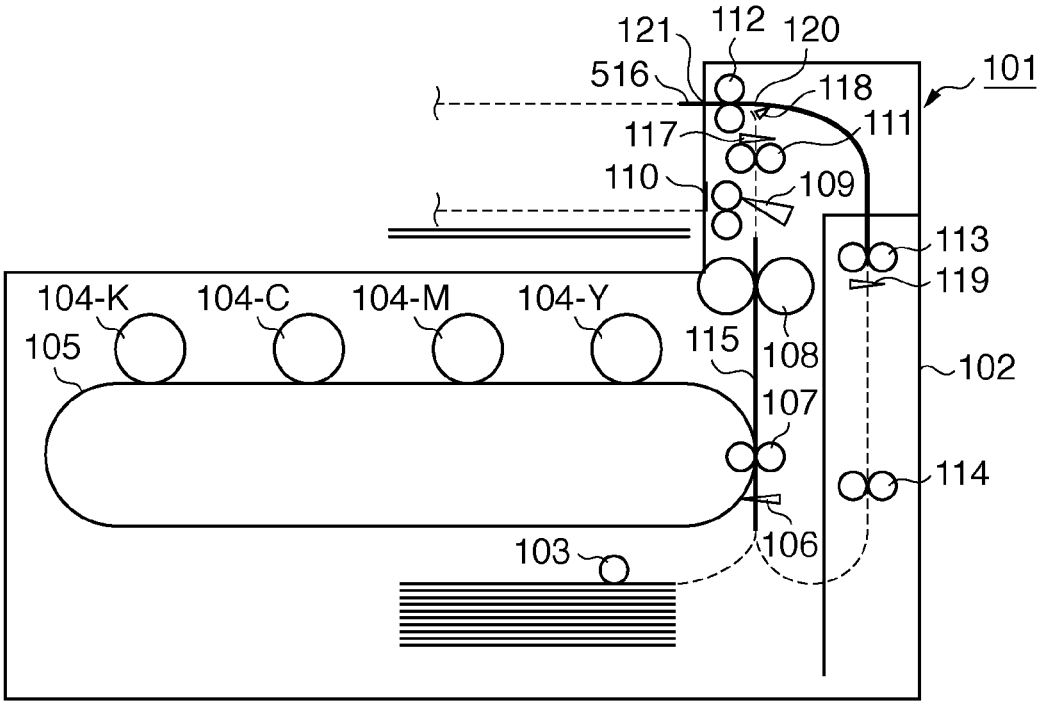
FIG. 5A is a diagram illustrating an example in which amount of exposure of paper is less than a threshold value and the leading edge of the paper is situated farthest downstream.

FIG. 5A is a diagram illustrating an example in which amount of exposure of paper is less than a threshold value and, moreover, the leading edge of the paper is situated farthest downstream. The length of paper sheet 516 is less than the length of the paper sheet 116 mentioned above. Accordingly, the exposure amount L3 is small and it is difficult to discharge the paper from the second discharge port 121 manually. In this case it is required that the paper 516 be extracted by opening the door 102, extracting the paper and then closing the door 102.

Figure 5B:
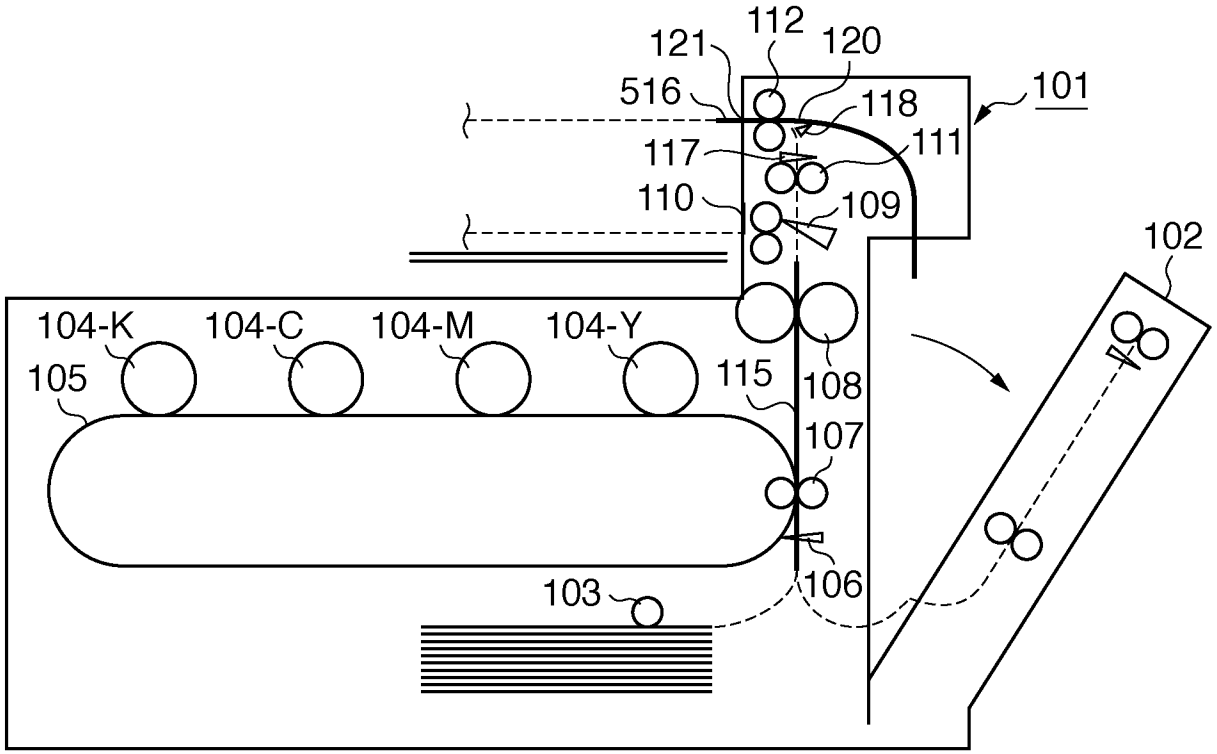
FIG. 5B is a diagram illustrating the manner in which a door 102 is opened.

FIG. 5B is a diagram illustrating the manner in which the door 102 is opened. Opening the door 102 makes it possible to remove the paper 516 manually.

If it is determined at step S406 that the exposure amount L3 is less than the threshold value, control proceeds to step S411. At step S411, the selector 332 selects a second message, which prompts the operator to remove the paper 516 upon opening the door 102, and outputs the message from the operation panel 304.

At step S412, the jammed-paper controller 302 detects by means of a door sensor 310 whether the door 102 has been opened. If the door 102 has been opened, control proceeds to step S413. At step S413, the jammed-paper controller 302 detects by means of the door sensor 310 whether the door 102 has been closed. If the door 102 has been closed, then control proceeds to step S409 described above.

Thus, even the paper 516 that cannot be sensed by any paper-presence sensing member provided in the second conveyance path can be removed properly. That is, it is possible to suppress further jamming that can be caused by resumption of printing while the paper 516 still remains retained within the apparatus.

It should be noted that there are rare cases where the third paper-presence sensing member 119 provided in the second conveyance path changes from "paper absent" to "paper present" immediately after paper conveyance is halted because jamming has been sensed.

Figure 6:
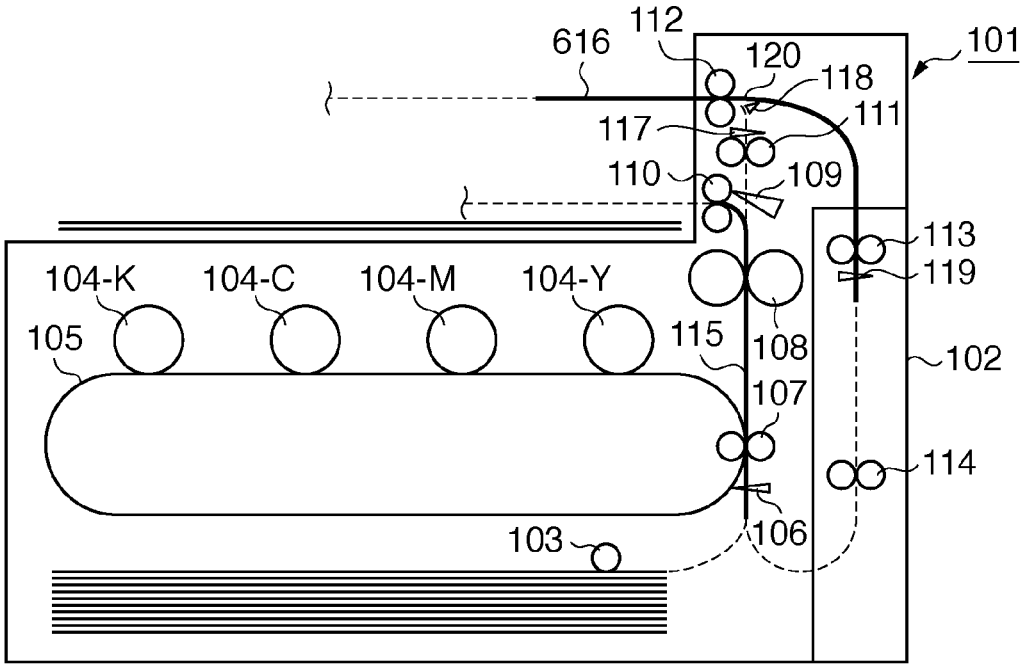
FIG. 6 is a diagram illustrating an example in which a paper-presence sensing member has changed from "paper absent" to "paper present" after halting of conveyance.

FIG. 6 is a diagram illustrating an example in which a paper-presence sensing member has changed from "paper absent" to "paper present" after halting of conveyance.

If the paper sheet 616 is pulled out of the second discharge port 121 in the direction opposite the conveyance direction, a flag on the third paper-presence sensing member 119 is subjected to a force in the direction opposite the conveyance direction and there is the possibility that flag will break off. The flag is a member that turns when it is struck by the leading edge of the paper. Whether or not the flag has turned usually is determined in accordance with whether light from a light-emitting element to a light-receiving element has been interrupted by the flag. If there is a possibility that some trouble such as breakage of the flag will occur in the conveyance path of image forming apparatus 101, it is preferred that the paper 616 be pulled out in the same direction as the conveyance direction. Naturally, if the conveyance path is provided with a flag for which there is no danger of destruction, then the paper 616 may be pulled out from the second discharge port 121.

In the example shown in FIG. 6, there is the possibility that the operator will be able to remove the paper if the door 102 is opened. If the door 102 is opened, however, some time and labor will be required for this user operation, inclusive of the labor involved in opening and closing the door. In addition, if the door 102 is opened, power supplied to the fixing unit is interrupted. This results in cooling of the fixing device 108 and a longer time for recovery of the fixing device 108. Accordingly, it is preferred that automatic paper discharge of the paper 616 be tried, thereby reducing the jam-processing load on the operator, reducing downtime and diminishing malfunction of the image forming apparatus 101.

If it is found at step S405 that the third paper-presence sensing member 119 provided in the second conveyance path is indicating presence of paper, then control proceeds to step S414.

At step S414, the selector 332 selects automatic paper discharge as the paper removal method. That is, no access point for manual removal of the paper 616 by the operator is made available. Here the selector 332 may omit output of the removal method to the operation panel 304. Alternatively, the selector 332 may output a third message reading "AUTOMATIC PAPER DISCHARGE IN PROGRESS", "PLEASE WAIT" or "DO NOT OPEN DOOR" to the operation panel 304.

At step S415, the automatic paper-discharge unit 340 rotates the conveyance motor 307 in order to discharge the paper 616. As a result, the first conveyance roller 113 and second conveyance roller 114, etc., rotate, the paper 616 is fed from the second conveyance path to the first conveyance path and is eventually discharged from the first discharge port 110.

At step S416, the jammed-paper controller 302 determines whether discharge of the paper 616 has succeeded. For example, when all of the paper-presence sensing members indicate absence of paper, then the jammed-paper controller 302 determines that discharge of the paper 616 has succeeded. If even a single one of these sensing members indicates presence of paper, then the jammed-paper controller 302 determines that discharge of the paper 616 has failed. If discharge succeeds, the image forming apparatus 101 is restored to the print-enabled state. If discharge fails, then control proceeds to step S411 described above.

In accordance with this embodiment, as described above, even in the case of a conveyance apparatus in which a sheet of paper is partially exposed to the exterior of the apparatus and the direction of paper conveyance is reversed, it is possible to suppress trouble along the conveyance path while jamming can be dealt with in a manner convenient for the operator.

In particular, according to this embodiment, the paper removal method is decided in accordance with the amount of exposure of a sheet of paper at a discharge port and the operator is notified of the method. The appropriate method that conforms to the amount of discharge should therefore be executed. Since the removal method is indicated, the paper-removing burden on the operator should be alleviated.

If the amount of paper exposure is an amount that allows the paper to be pulled out by the operator, then the operator can be prompted to pull the paper out of the discharge port manually. This means that it is possible to suppress situations in which the door 102 is open inadvertently, resulting in downtime, which is time during which image formation cannot be carried out.

It should be noted that a message for suppressing opening of the door may be presented to the operator proactively. This would make it easier for the operator to realize that opening the door is undesirable.

Further, it is preferred that the operator be prompted to pull out the paper from the second discharge port if none of the one or more paper sensors provided in the second conveyance path can detect the presence of paper despite the fact that jamming has occurred. On the other hand, it is preferred that automatic discharge of the paper be tried if any of the one or more paper sensors provided in the second conveyance path senses the presence of paper. The reason is to avoid the opening of door 102 to the maximum extent.

When the amount of exposure is less than the threshold value, it should be difficult to pull the paper out of the second discharge port 121 manually. In such case, therefore, it is preferred that the second message, which prompts the operator to pull out the paper manually upon opening the door 102, be selected and reported to the operator. In this embodiment, however, the ratio at which the door 102 is opened in comparison with heretofore is reduced. As a result, downtime accompanying recovery of the fixing device 108 is reduced.

Other Embodiments

The foregoing embodiment is described with regard to operation when jamming occurs at the start of reversed conveyance of paper. However, the present invention is also applicable to an instance where jamming occurs when paper is being discharged to the first discharge port.

Jamming occurs also if, while a sheet of paper on which an image has been formed is being discharged from the first discharge port, the next sheet of paper fails to be conveyed properly and is retained in or stops within the apparatus. In such case also the leading sheet of paper will stop in the course of being discharged from the first discharge port. The measurement unit 321 measures the length L0 of the sheet of paper in the conveyance direction. The estimating unit 320 estimates the amount of paper conveyance using conveyance time that elapses from the moment the first paper-presence sensing member 106 indicates absence of paper, as well as the paper conveyance speed, etc., thereby estimating the amount of paper exposure during discharge.

Figure 7:
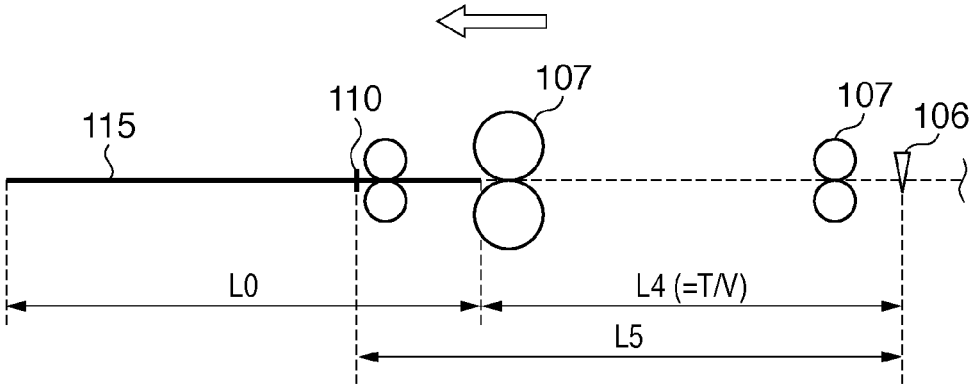
FIG. 7 is a schematic view illustrating paper conveyance direction in another embodiment of the present invention.

FIG. 7 is a schematic view illustrating paper conveyance direction in another embodiment of the present invention. The direction of the large arrow in FIG. 7 is the direction in which the paper is conveyed. For example, letting T represent time that elapses from the moment the first paper-presence sensing member 106 indicates absence of paper and letting V represent the conveyance speed of paper 115, conveyance distance presence traveled by the paper 115 after the first paper-presence sensing member 106 indicates absence of paper is L4=T/V. Then, using the conveyance distance L4, a distance L5 from the first paper-presence sensing member 106 to the first discharge port 110 and the length L0 of the sheet of paper 115 in the conveyance direction, the exposure amount L3 can be calculated according to the following equation:

$$L3=L0-(L5-L4)$$

The comparator 331 compares the estimated exposure amount L3 with the threshold value, as described above. In accordance with the result of comparison, the decision unit 330 selects a message prompting the user to pull out the paper without performing a jam removal operation that relies upon opening and closing a door and outputs this message from the operation panel 304. It should be noted that the door in this case is different from the door 102 described above and signifies a door for extracting paper remaining retained in the first discharge port 110.

In accordance with this embodiment, as in the above-described embodiment, it is possible to suppress trouble along the conveyance path while jamming is dealt with in a manner convenient to the operator.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-076407, filed Mar. 24, 2008, and 2009-049717, filed Mar. 3, 2009, which are hereby incorporated by reference herein in their entirety.

What is claimed is:

1. A conveyance apparatus for conveying a printing medium, comprising:

a discharge port through which the conveyed printing medium is discharged to an exterior of the conveyance apparatus; and a control unit configured to control the conveyance operation of the printing medium such that the printing medium is conveyed to said discharge port, a conveyance direction of the printing medium is reversed after a part of the printing medium is exposed from said discharge port to the exterior of the conveyance apparatus, and the printing medium is conveyed to an interior of the conveyance apparatus, wherein said control unit is further configured to output information concerning a removal method of the printing medium according to an amount of exposure of the printing medium stopped at said discharging port.

2. The apparatus according to claim 1, wherein said control unit is further configured to:

estimate the amount of exposure of the printing medium stopped at said discharge port as the conveyance direction of the printing medium is being changed;

when a state in which the printing medium remains retained in the conveyance apparatus occurs, compare the estimated amount of exposure and a prescribed threshold value; and when the estimated amount of exposure is equal to or greater than the threshold value, select a first message as the information concerning the removal method, the first message prompting an operator to pull out the printing medium from said discharge port.

3. The apparatus according to claim 2, wherein the first message includes a message for suppressing opening and closing of a door provided on said conveyance apparatus.

4. The apparatus according to claim 2, further comprising:

a conveyance path configured to convey the printing medium of which a conveyance direction has been reversed, and a printing medium detection unit which detects an absence or presence of a printing medium conveyed on said second conveyance path, wherein said control unit is further configured to select the first message if said printing medium detection unit is not detecting a presence of the printing medium when a state in which the printing medium remains retained in the apparatus occurs.

5. The apparatus according to claim 4, further comprising an automatic discharge unit which tries to discharge the printing medium automatically if said printing medium detection unit is detecting a presence of the printing medium during a state in which the printing medium remains retained in the apparatus occurs.

6. The apparatus according to claim 5, wherein when automatic discharge of the printing medium is attempted, said output unit does not output the information concerning the removal method.

7. The apparatus according to claim 2, wherein when the estimated amount of exposure is less than the threshold value, said control unit selects a second message prompting the operator to open a door provided on said conveyance apparatus, remove the printing medium and close the door.

8. The apparatus according to claim 2, wherein said control unit is further configured to:

measure a length of the printing medium in the conveyance direction;

measure an amount by which the printing medium, which has been halted temporarily in order for the conveyance direction thereof to be reversed, has been pulled into the conveyance path; and calculate the amount of exposure from the measured length and the measured amount by which the printing medium has been pulled in.

9. The apparatus according to claim 1, wherein the information is information for instructing to pull out the printing medium from said discharge port to the exterior of the apparatus.

10. The apparatus according to claim 1, wherein the information is information for instructing to open a door of the apparatus and remove the printing medium.

11. A conveyance apparatus for conveying a printing medium, comprising:

a discharge port through which the conveyed printing medium is discharged to an exterior of the conveyance apparatus; and an output unit which outputs information concerning processing the printing medium being stopped at said discharge port, wherein information output from the output unit in a case where an exposure length of the printing medium stopped at said discharging port and exposed from said discharge port is equal to or longer than a threshold value is different from information output from the output unit in a case where the exposure length of the printing medium stopped at said discharging port and exposed from said discharge port is shorter than the threshold value.

12. The apparatus according to claim 11, further comprising a control unit configured to:

estimate the exposure length of the printing medium at said discharge port;

when a state in which the printing medium remains retained in the apparatus occurs, compare the estimated exposure length and the threshold value; and when the estimated exposure length is equal to or greater than the threshold value, select a first information concerning a removal method of the recording medium, the first information prompting an operator to pull out the printing medium from said discharge port.

13. The apparatus according to claim 12, wherein the first information includes a message for suppressing opening and closing of a door provided on said conveyance apparatus.

14. The apparatus according to claim 11, wherein the information is information for instructing to pull out the printing medium from said discharge port to the exterior of the apparatus.

15. The apparatus according to claim 11, wherein the information is information for instructing to open a door of the apparatus and remove the printing medium.

16. An image forming apparatus comprising:

an image forming unit which forms an image on a printing medium;

a discharge port through which the printing medium is discharged to the exterior of the image forming apparatus; and a control unit configured to control a conveyance operation of the printing medium such that the printing medium is conveyed to said discharge port, a conveyance direction of the printing medium is reversed after a part of the printing medium is exposed from said discharge port to an exterior of the image forming apparatus, and the printing medium is conveyed to an interior of the image forming apparatus, wherein said control unit is further configured to output information concerning a removal method of the printing medium according to an amount of exposure of the printing medium stopped at said discharging port.

17. The apparatus according to claim 16, wherein said control unit is further configured to:

estimate the amount of exposure of the printing medium at said discharge port when the conveyance direction of the printing medium is being changed;

when a state in which the printing medium remains retained in the conveyance apparatus occurs, compare the estimated amount of exposure and a prescribed threshold value; and when the estimated amount of exposure is equal to or greater than the threshold value, select a first message as the information concerning the removal method, the first message prompting an operator to pull out the printing medium from said discharge port.

18. The apparatus according to claim 17, wherein the first message includes a message for suppressing opening and closing of a door provided on said image forming apparatus.

19. The apparatus according to claim 16, wherein the information is information for instructing to pull out the printing medium from said discharge port to the exterior of the apparatus.

20. The apparatus according to claim 16, wherein the information is information for instructing to open a door of the apparatus and remove the printing medium.

21. An image forming apparatus comprising:

an image forming unit which forms an image on a printing medium;

a discharge port through which the conveyed printing medium is discharged to the exterior of the conveyance apparatus; and an output unit which outputs information concerning processing the printing medium being stopped at said discharge port, wherein information output from the output unit in a case where an exposure length of the printing medium stopped at said discharging port and exposed from said discharge port is equal to or longer than a threshold value is different from information output from the output unit in a case where the exposure length of the printing medium stopped at said discharging port and exposed from said discharge port is shorter than the threshold value.

22. The apparatus according to claim 21, further comprising a control unit configured to:

estimate exposure length of the printing medium stopped at and exposed from said discharge port when the conveyance direction of the printing medium is being changed;

when a state in which the printing medium remains retained in the conveyance apparatus occurs, compare the estimated exposure length and the threshold value; and when the estimated exposure length is equal to or greater than the threshold value, select a first information concerning a removal method of the recording medium, the first information prompting an operator to pull out the printing medium from said discharge port.

23. The apparatus according to claim 22, wherein the first information includes a message for suppressing opening and closing of a door provided on said conveyance apparatus.

24. The apparatus according to claim 21, wherein the information is information for instructing to pull out the printing medium from said discharge port to the exterior of the apparatus.

25. The apparatus according to claim 21, wherein the information is information for instructing to open a door of the apparatus and remove the printing medium.

26. A conveyance apparatus comprising:

a discharge port through which a printing medium is discharged to the exterior of the conveyance apparatus;

a conveyance unit which conveys the printing medium to said discharge port through a transport path; and an output unit which outputs information concerning processing of the printing medium when the printing medium stops and a part of the printing medium is exposed from said discharge port, wherein said output unit outputs the information according to information concerning a distance by which the stopped printing medium is conveyed from a predetermined position in the transport path to a stopped position of the stopped printing medium.

27. The conveyance apparatus according to claim 26, wherein said output unit outputs information prompting that the stopped printing medium should be pulled out from said discharge port when the distance is equal or longer than a threshold value.

28. The conveyance apparatus according to claim 26, wherein said output unit outputs information prompting that the stopped printing medium should be removed by opening a door of the conveyance apparatus when the distance is shorter than a threshold value.

29. The conveyance apparatus according to claim 26, further comprising a sensor which senses at the predetermined position a printing medium conveyed to the conveyance path.

30. An image forming apparatus comprising:

an image forming unit which forms an image on a printing medium;

a discharge port through which the conveyed printing medium is discharged to the exterior of the conveyance apparatus;

a conveyance unit which conveys the printing medium to said discharge port through a transport path; and an output unit which outputs information concerning processing of the printing medium when the printing medium stops and a part of the printing medium is exposed from said discharge port, wherein said output unit outputs the information according to information concerning a distance by which the stopped printing medium is conveyed from a predetermined position in the transport path to a stopped position of the stopped printing medium.

31. The image forming apparatus according to claim 30, wherein said output unit outputs information prompting that the stopped printing medium should be pulled out from said discharge port when the distance is equal or longer than a threshold value.

32. The image forming apparatus according to claim 30, wherein said output unit outputs information prompting that the stopped printing medium should be removed by opening a door of the image forming apparatus when the distance is shorter than a threshold value.

33. The conveyance apparatus according to claim 30, further comprising a sensor which senses at the predetermined position a printing medium conveyed to the conveyance path.

* * * * *